United States Patent [19]

Gregg

[11] 4,019,235

[45] Apr. 26, 1977

[54] PISTON PULLER

[76] Inventor: Leonard Gregg, 7 Kohlmeyer Lane, Pittsburgh, Pa. 15211

[22] Filed: Apr. 30, 1976

[21] Appl. No.: 681,812

[52] U.S. Cl. ..... 29/280; 29/283

[51] Int. Cl.[2] ..... B25B 27/14

[58] Field of Search ..... 29/283, 234, 280, 263, 29/282

[56] References Cited

UNITED STATES PATENTS

| | | | |
|---|---|---|---|
| 1,435,278 | 11/1922 | Campbell | 29/263 |
| 2,050,005 | 8/1936 | Heegeman | 29/263 |
| 2,646,619 | 7/1953 | McCord | 29/263 |

FOREIGN PATENTS OR APPLICATIONS

| | | | |
|---|---|---|---|
| 815,256 | 4/1937 | France | 29/263 |

*Primary Examiner*—James L. Jones, Jr.

*Attorney, Agent, or Firm*—Webb, Burden, Robinson & Webb

[57] ABSTRACT

A tool for removing a piston from a cylinder of a piston driven engine, particularly a diesel engine, comprises a cylindrical sleeve member having a length greater than the length of the piston to be removed, an outside diameter less than the diameter of the cylinder and in side diameter greater than the diameter of the piston. There are means adjacent one end of the sleeve member for inserting the sleeve into and removing the sleeve member from the cylinder. There are biasing means adjacent the opposite end of the sleeve member, such as flexible tabs and/or a coil spring, for engaging a wall of the piston, for example the bottom wall, to enable the sleeve member to be withdrawn from the cylinder within the sleeve member. The opposite end of the sleeve member is slightly beveled to facilitate entrance of the sleeve member into the cylinder, over the piston.

In a preferred embodiment of the invention, the means for inserting and removing the sleeve member preferably includes means for abutting the top of the piston in such a way as to locate the sleeve member with respect to the piston. In this embodiment, the cylindrical sleeve member is preferably formed of thin stainless steel and includes a longitudinal separation. The sleeve member also includes a lateral annulus near the opposite end and the biasing means, such as a spring, is located in the annulus for engaging the bottom wall of the piston. After the sleeve member is inserted into the cylinder an outer cylindrical sleeve member is placed around the cylindrical sleeve member to tightly engage and lock the sleeve member onto the piston so that it can be withdrawn from the cylinder.

10 Claims, 7 Drawing Figures

PISTON PULLER

This invention relates to a piston puller and particularly to a tool for use in removing a piston and its connecting rod from a cylinder of a piston driven engine, such as a diesel engine.

Heavy duty diesel engines used on trucks, tractors, and the like generally are provided with cylinder liners. It has been common practice to replace these cylinder liners from time to time and when they become worn or cracked. Heretofore pulling tools used to replace the cylinder liners have required that the pistons be removed from the cylinders before the tool could be operably inserted into the engine block. Recently, tools, such as my own tool for removing ported cylinder liners which is the subject of U.S. Pat. No. 3,875,641, have made it unnecessary to first remove the pistons from the cylinders before the tool could be used. However, there are circumstances under which it is desirable to remove the piston from the cylinder for inspection, replacement, renewal or the like. The present invention is particularly useful for removing a piston from a cylinder of a piston driven engine having a cylinder liner which can be removed from the cylinder by means of a tool such as my previously patented tool for removing ported cylinder liners. It may also be used for removing pistons from engines having large diameter cylinders.

My invention is a tool for removing a piston from a cylinder of a piston driven engine, especially a diesel engine, comprising, in one embodiment, a cylindrical sleeve member having a length greater than the length of the piston to be removed, an outside diameter less than the diameter of the cylinder and an inside diameter greater than the diameter of the piston. There are means, adjacent one end of the sleeve member for inserting the sleeve member into and removing it from the cylinder. There are biasing means on the sleeve member adjacent its opposite end for engaging a wall, usually the bottom wall, of the piston to enable it to be withdrawn from the cylinder and within the sleeve member. In a preferred embodiment of the invention, the means for inserting and removing the tool from the cylinder may also be utilized for locating the sleeve member with respect to the piston, such as by providing that the means abut one end of the piston. In this embodiment, the cylindrical sleeve has a longitudinal separation and the means adjacent the opposite end of the sleeve member comprise a lateral annulus having located therein a biasing means, such as a coil spring, for engaging the wall of the piston. The cylindrical sleeve member is locked in position by an outer cylindrical sleeve member.

In the operation of the tool, the cylinder liner is first withdrawn from the cylinder leaving an annulus into which the cylindrical sleeve member according to my invention can be inserted for the purpose of withdrawing the piston from the cylinder. The annulus is of sufficient width to receive a single cylindrical sleeve member having biasing means adjacent its opposite end for engaging the bottom wall of the piston or for receiving a cylindrical sleeve member of light gauge material, such as thin stainless steel, having biasing means, and an outer cylindrical sleeve member for locking the light gauge cylindrical sleeve member in position with the biasing means engaging a wall of the piston. In both embodiments, the tool is suitable for removing a piston from a cylinder of a piston driven engine with ease.

The tool according to the invention is of relatively simple design, requires minimum material and consequently is relatively inexpensive to produce. It facilitates the removal of a piston from a cylinder for inspection, replacement, renewal or the like.

Other and further advantages of the invention will be apparent to those skilled in the art from the following description taken with the accompanying drawings in which.

Figure 1:
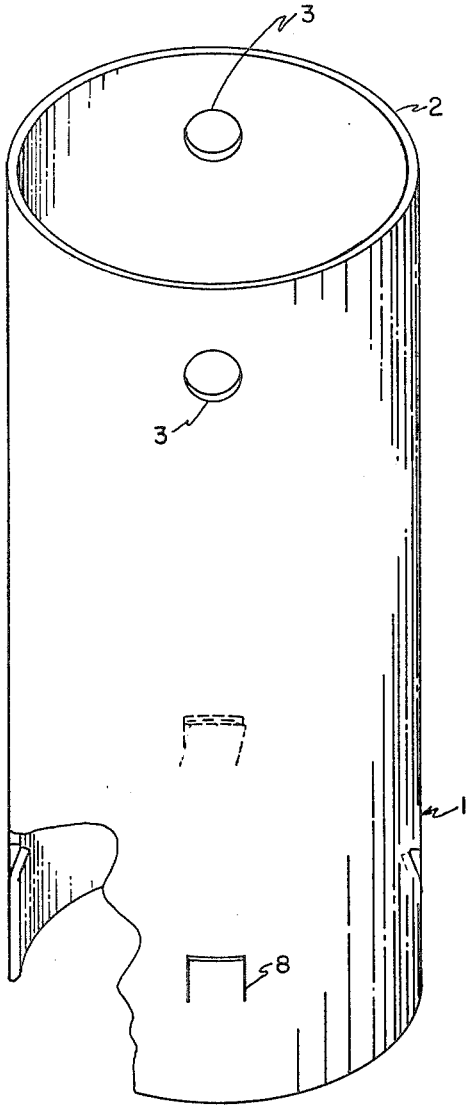
FIG. 1 is a perspective view partly broken away showing the cylindrical sleeve member according to a first embodiment of the invention.
Figure 2:
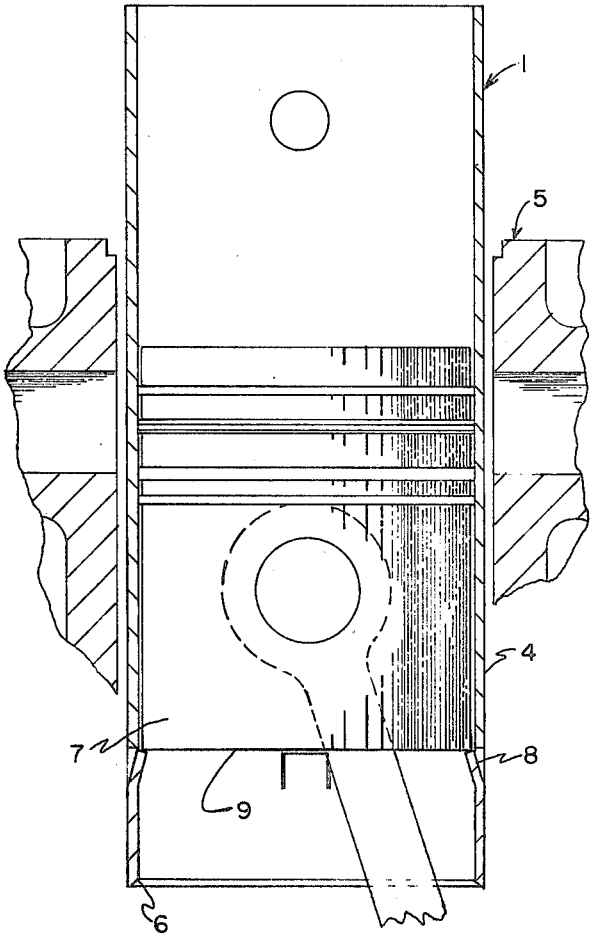
FIG. 2 is a cross-sectional view showing the tool in position for pulling a piston from a cylinder in an engine block.

Referring to the embodiment of the tool shown in FIGS. 1 and 2 of the drawings, a cylindrical sleeve member 1 includes a thin wall 2 and is open at its ends. There are holes 3 located opposite each other in the wall 2 in which means, such as a rod, can be placed for inserting the sleeve member into a cylinder 4 in engine block 5 and withdrawing it therefrom. The opposite end of the sleeve member is slightly beveled as at 6 (See FIG. 2) to facilitate insertion of the cylindrical sleeve member into the cylinder over a piston 7. Adjacent the opposite end of the sleeve member there are biasing means, such as flexible tabs 8, for engaging the piston. Although four tabs are shown, any number of tabs may be used provided the number of tabs does not substantially weaken the sleeve member near its opposite end.

The operation of the tool is straightforward. After the cylinder liner has been removed (for example by the use of the tool of my U.S. Pat. No. 3,875,641) the cylindrical sleeve member 1 is inserted into the annulus previously occupied by the liner. The sleeve member is pushed past the piston 7, the tabs 8 frictionally engaging the side of the piston as it passes from top to bottom of the cylinder until the tabs 8 extend below the bottom wall 9 of the piston. As shown in FIG. 2, after the tabs 8 engage the bottom wall 9 of the piston, the piston (and connecting rod 10) may be withdrawn within the sleeve member by lifting the cylindrical sleeve member from the cylinder.

In large engines having no liner, the cylindrical sleeve member will pass between the cylinder wall and the piston. The tool operation is the same as heretofore described.

Figure 3:
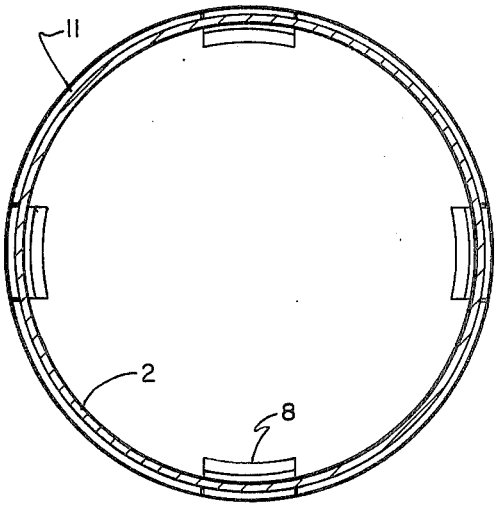
FIG. 3 is a cross-sectional view taken through the plane of the tabs shown in FIG. 1 of an alternative embodiment of the invention.
Figure 5:
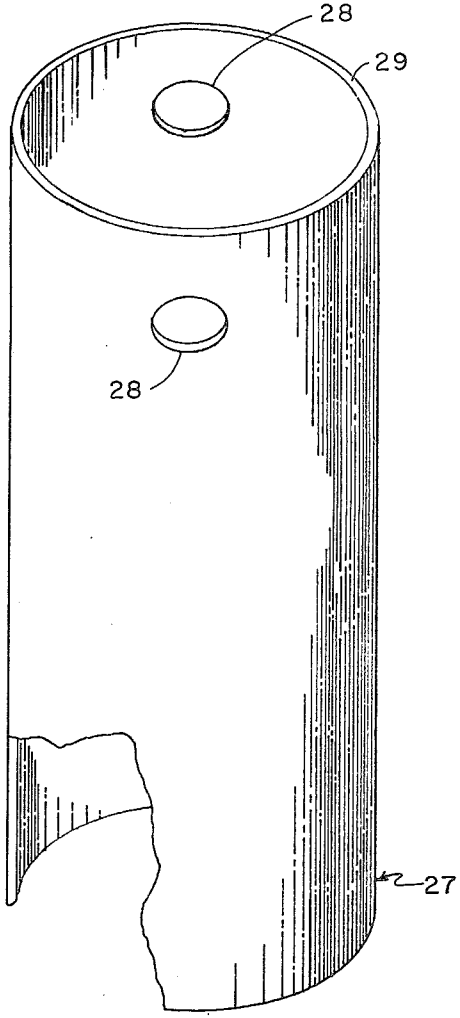
FIG. 5 is a perspective view partly broken away of an outer or locking sleeve member for use with the cylindrical sleeve member shown in FIG. 4.
Figure 4:
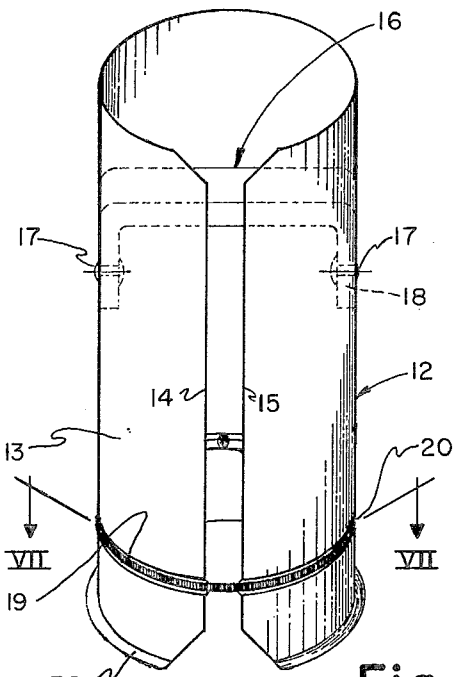
FIG. 4 is a perspective view on a reduced scale of a cylindrical sleeve member according to a second embodiment of the invention.
Figure 7:
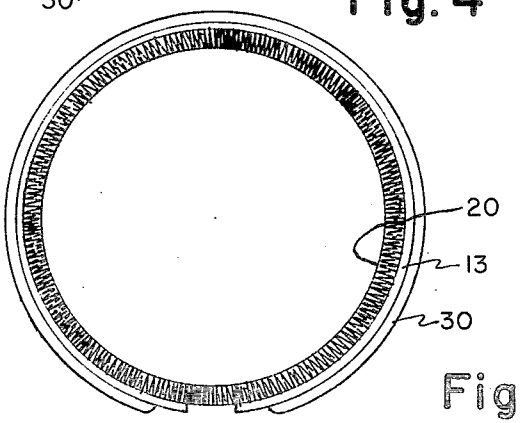
FIG. 7 is a cross-sectional view taken along lines VII—VII of FIG. 4.

As shown in FIG. 3, in an alternative embodiment of the tool, an annulus 11 may be formed around the cylindrical sleeve member in alignment with the tabs 8. A coil spring may be disposed in the annulus to force the tabs inwardly to insure that they securely engage the bottom wall 9 of the piston so that it may be withdrawn from the cylinder.

A preferred embodiment of the invention is shown in FIGS. 4 through 7 of the drawings. In this embodiment a thin-walled cylindrical sleeve member 12 is used. As shown particularly in FIG. 4, the sidewall 13 of the sleeve member, which is preferably made of stainless steel, is longitudinally separated at edges 14 and 15. A handle member 16 is secured adjacent one end of the sleeve member, for example by rivets 17. The handle member includes depending legs 18. Adjacent the opposite end of the sleeve member 12 is an annulus 19 which extends laterally of the sidewall 13. Biasing means, such as a coil spring 20 disposed in the annulus 19, completely encircles the sidewall (see FIG. 7) tending to compress the diameter of the sleeve member and close the separation between the sidewall edges 14 and 15 of the sleeve member.

Figure 6:
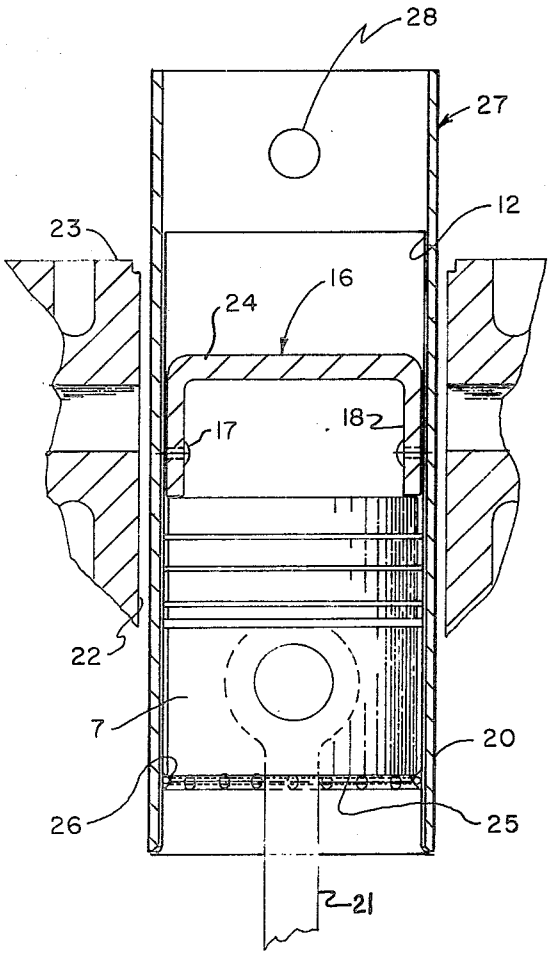
FIG. 6 is a cross-sectional view showing the tool in position for pulling a piston from a cylinder in an engine block.

As shown in FIG. 6, to remove a piston 7 (and its connecting rod 21) from a cylinder 22 in a block 23 of a piston driven engine the cylindrical sleeve member 12 is inserted into the annulus in the cylinder from which a cylinder liner was removed to the point where the depending legs 18 of the handle member 16 abut top wall 24 of the piston. The sleeve member is thus located with respect to the piston so that the biasing means, coil spring 20, extends just below bottom wall 25 of the piston and the piston wall rests on the annulus ledge 26 of the sleeve member. Although it is possible to remove the piston from the cylinder using only the sleeve member 12, I prefer to use an outer or locking sleeve member 27 (see FIG. 5) which tightly engages the sleeve member to the piston for withdrawal. The outer sleeve member also extends into the annulus provided by the prior removal of the cylinder liner. Adjacent one end of the outer sleeve member 27 is a pair of holes 28 in opposite portions of sidewall 29 of the outer cylindrical sleeve member for use with a pulling rod (not shown). The outer sleeve member may be inserted into the cylinder and withdrawn therefrom independently of the sleeve member 12; the extent of insertion may be limited, however, by a circumferential flange 30 which may be included on the end of the cylindrical sleeve member 12. When the outer or locking sleeve member 27 is employed, it securely locks the cylindrical sleeve member 12 in engagement with the piston and permits the piston to be withdrawn from the cylinder through the cylindrical outer sleeve member 27.

Further and other embodiments of the invention will be apparent to those having ordinary skill in the art. The invention I have disclosed is applicable to all types of piston driven engines, particularly diesel engines, and facilitates cylinder, cylinder liner and piston inspection, replacement, and/or renewal.

Having described presently preferred embodiments of the invention, it should be understood that the invention is otherwise embodied within the scope of the appended claims.

I claim:

1. A tool for removing a piston from a cylinder of a piston driven engine wherein the tool is adapted to be inserted into an annulus defined by the cylinder wall and the piston, said tool comprising:

A. a cylindrical sleeve member having a length greater than the length of the piston to be removed, an outside diameter less than the diameter of the cylinder and an inside diameter greater than the diameter of the piston;

B. means adjacent one end of the sleeve member for inserting the sleeve member into the cylinder; and C. means adjacent the opposite end of the sleeve member for engaging a wall of the piston to enable it to be withdrawn from the cylinder within the sleeve member.

2. A tool as claimed in claim 1 in which the means for inserting the sleeve member in the cylinder includes means for locating the sleeve member with respect to the piston.

3. A tool as claimed in claim 2 in which the means adjacent one end of the sleeve member for inserting the sleeve member in the cylinder and for locating the sleeve member with respect to the piston comprises a handle member having depending legs which are adapted to abut a wall of the piston upon insertion of the tool in a cylinder for removing the piston.

4. A tool as claimed in claim 1 in which the means for inserting the sleeve member comprises a handle member.

5. A tool as claimed in claim 1 in which the means for engaging the wall of the piston comprises biasing means.

6. A tool as claimed in claim 5 in which the biasing means comprises at least two flexible tabs adapted to engage a bottom wall of the piston.

7. A tool as claimed in claim 1 in which the cylindrical sleeve member comprises a light gauge member having a longitudinal separation therein.

8. A tool as claimed in claim 7 in which the opposite end of the sleeve member includes an annulus extending laterally therearound and a biasing means is disposed in the annulus for engaging a wall of the piston.

9. A tool as claimed in claim 8 in which the biasing means comprises a coil spring.

10. A tool as claimed in claim 9 and including an outer cylindrical sleeve member for locking the biasing means of the cylindrical sleeve member in engagement with a wall of the piston to enable it to be withdrawn from the cylinder within the sleeve member.

* * * * *